US009278384B2

(12) United States Patent
Da Silva Alves

(10) Patent No.: US 9,278,384 B2
(45) Date of Patent: Mar. 8, 2016

(54) PRESS BRAKE

(71) Applicant: ADIRA, S.A., Oporto (PT)

(72) Inventor: Antonio Da Silva Alves, Oporto (PT)

(73) Assignee: ADIRA, S.A., Porto (PT)

( * ) Notice: Subject to any disclaimer, the term of this patent is extended or adjusted under 35 U.S.C. 154(b) by 0 days.

(21) Appl. No.: 14/437,353

(22) PCT Filed: Oct. 22, 2013

(86) PCT No.: PCT/IB2013/059544

§ 371 (c)(1),
(2) Date: Apr. 21, 2015

(87) PCT Pub. No.: WO2014/064615

PCT Pub. Date: May 1, 2014

(65) Prior Publication Data

US 2015/0298191 A1 Oct. 22, 2015

(30) Foreign Application Priority Data

Oct. 22, 2012 (PT) ..... 106592

(51) Int. Cl.
*B21D 7/06* (2006.01)
*B21D 5/00* (2006.01)
(Continued)

(52) U.S. Cl.
CPC ..... *B21D 5/002* (2013.01); *B21D 5/0209* (2013.01); *B21D 5/0272* (2013.01); *B30B 15/0041* (2013.01); *B30B 15/041* (2013.01);
(Continued)

(58) Field of Classification Search
CPC .... B30B 15/0041; B30B 15/18; B30B 15/24; B30B 15/041; B30B 15/047; B21D 5/02; B21D 5/0209
USPC ..... 72/389.3
See application file for complete search history.

(56) References Cited

U.S. PATENT DOCUMENTS 2,051,447 A * 8/1936 Johansen ..... B30B 15/041 100/231
2,312,755 A * 3/1943 Dehn ..... B21D 5/02 72/31.01

(Continued)

FOREIGN PATENT DOCUMENTS

EP 2085162 A1 8/2009
GB 2256608 A 12/1992

OTHER PUBLICATIONS

International Search Report dated Apr. 4, 2014 for PCT/IB2013/059544 in English.

*Primary Examiner* — David B Jones
(74) *Attorney, Agent, or Firm* — Lucas & Mercanti, LLP

(57) ABSTRACT

Press brake (1) comprising a top tool (2) and a bottom tool (3), for bending or pressing workpieces between said opposing tools; a displaceable upper beam (4), wherein the top tool (2) is mounted upon; a bottom beam (5), wherein the bottom tool (3) is mounted upon; a load bearing frame (61) mounted extending transversally, comprising a concave opening, wherein the bottom beam (5) is mounted on the bottom part; force means (7) mounted between the upper beam (4) and the upper part of the load bearing frame (61) for opposing the upper and lower tools (2, 3); an alignment frame (62) mounted extending transversally, comprising a concave opening, wherein the bottom beam (5) is mounted on the bottom part of the alignment frame (62); sliding means (8) mounted between the upper beam (4) and the upper part of the alignment frame (62).

22 Claims, 9 Drawing Sheets

(51) Int. Cl.

| | |
|---|---|
| ***B30B 15/04*** | (2006.01) |
| ***B30B 15/24*** | (2006.01) |
| ***B30B 15/18*** | (2006.01) |
| ***B30B 15/00*** | (2006.01) |
| ***B21D 5/02*** | (2006.01) |

(52) U.S. Cl.
CPC ..... *B30B15/047* (2013.01); *B30B 15/18* (2013.01); *B30B 15/24* (2013.01)

(56) References Cited

U.S. PATENT DOCUMENTS 3,991,602 A * 11/1976 Harcuba ..... B30B 15/047 100/231
4,148,203 A * 4/1979 Farazandeh ..... B21D 5/02 100/46
4,366,699 A * 1/1983 Tsuchiyama ..... B30B 15/24 100/258 A
4,389,874 A * 6/1983 Riboldi ..... B30B 15/18 72/389.3
4,590,784 A * 5/1986 Okabe ..... B30B 1/16 72/389.3
4,672,835 A 6/1987 Liet
5,052,208 A * 10/1991 Sartorio ..... B21D 5/02 100/231
5,813,322 A * 9/1998 Kuroda ..... B30B 15/0041 100/231

* cited by examiner

PRESS BRAKE

CROSS REFERENCE TO RELATED APPLICATON

This Application is a 371 of PCT/IB2013/059544 filed on Oct. 22, 2013 which, in turn, claimed the priority of Portuguese Patent Application No. 106592 filed on Oct. 22, 2012, both applications are incorporated herein by reference.

TECHNICAL FIELD

The present invention relates to a press brake machine, in particular for bending or pressing materials, wherein supplementary means are provided for ensuring alignment and consistent bending and pressing operations.

SUMMARY

The disclosure comprises a press brake (1) for bending or pressing workpieces, comprising:

- a top tool (2) and a bottom tool (3), for bending or pressing workpieces between said opposing tools;
- an displaceable upper beam (4), wherein the top tool (2) is mounted upon;
- a bottom beam (5), wherein the bottom tool (3) is mounted upon, said bottom beam (5) being substantially parallel to the upper beam (4);
- a load bearing frame (61) mounted extending transversally to said beams (4, 5), comprising a concave opening facing said beams (4, 5), wherein the bottom beam (5) is mounted on the bottom part of the load bearing frame (61) relative to the concave opening;
- force means (7) mounted between the upper beam (4) and the upper part of the load bearing frame (61) relative to the concave opening, for opposing the upper and lower tools (2, 3);
- an alignment frame (62) mounted extending transversally to said beams (4, 5), comprising a concave opening facing said beams (4, 5), wherein the bottom beam (5) is mounted on the bottom part of the alignment frame (62) relative to the concave opening;
- sliding means (8) mounted between the upper beam (4) and the upper part of the alignment frame (62) relative to the concave opening.

In an embodiment the sliding means (8) are a sliding joint (8A, 8B).

In an embodiment the sliding means (8) comprise an axial slot (8B) and a mating flange (8A).

In an embodiment the sliding means (8) are adapted to accommodate a predefined degree of rotation of the upper beam (4) in the plane parallel to the upper beam (4) displacement.

In an embodiment the load bearing frame (61) and the alignment frame (62) are partially joined.

In an embodiment the alignment frame (62) and the load bearing frame (61) comprise layers which overlap and are partially joined.

In an embodiment the alignment frame (62) and the load bearing frame (61) are joined by joining part of the overlapping inner rims of the concave openings of each frame (61, 62).

In an embodiment the joined part of the overlapping inner rims of the concave openings extends from the joining of the load bearing (61) and alignment (62) frames to the bottom beam (5) up to a predetermined inner rim joint angle ($\alpha$), said angle being measured from the bottom beam (5) direction along the concave opening towards the upper beam (4) direction.

In an embodiment the predetermined inner rim joint angle ($\alpha$) is −20 to 20°, in particular −10 to 10°, in particular −5 to 5°, in particular −2 to 2°.

In an embodiment the alignment frame (62) is "C"-shaped.

In an embodiment the alignment frame (62) and the load bearing frame (61) are joined by joining part of the outer rim of the alignment frame (62) to the load bearing frame (61).

In an embodiment the joined part of the outer rim of the alignment frame (62) extends from the joining of the load bearing (61) and alignment (62) frames to the bottom beam (5) up to a predetermined outer rim joint angle ($\alpha$), said angle being measured from the bottom beam (5) direction along the concave opening towards the upper beam (4) direction.

In an embodiment the predetermined outer rim joint angle ($\alpha$) is 75 to 120°, in particular 85 to 110°, in particular 90 to 105°, in particular 98 to 102°.

In an embodiment the load bearing frame (61) is "C"-shaped.

An embodiment comprises two such alignment frames (62) joined in layers, each on a side of a load bearing frame (61) layer.

In an embodiment the sliding means (8) are adapted to impart a predefined path to the movement of the upper beam (4).

In an embodiment the sliding means (8) are further adapted to impart a predefined direction to the upper beam (4) movement along said predefined path.

DISCLOSURE OF THE INVENTION

It is one of the objectives of the disclosure to provide improved embodiments of a press brake machine in terms of more precise and consistent bending and pressing operations.

A press-brake machine (1), also known as a brake press or press brake, is a machine for bending or pressing sheet and plate material, the workpiece, this most commonly being sheet metal. It forms predetermined bends by clamping the workpiece between two tools, top (2) and bottom (3), usually a matching punch and die. It can also press the workpiece according to the shape of the top and bottom tools (2, 3), usually a matching groove and stamp.

Also usually, the top tool (2), or upper tool, is mounted on a displaceable upper beam (4), while the bottom tool (3) is mounted on a table (5). This is because normally the top tool (2) is movable in the direction of the bottom tool (3) in order to bend or press the workpiece, while the bottom tool (3) is static. The bottom tool mount can also be designated as a beam (5). This direction of travel of the tool is usually designated by vertical direction of the press-brake.

Conversely, the inverse is also possible, the top tool (2) being static and the bottom tool (3) being movable and it is even possible that both tools are movable. In these cases, the tool mounts are generically called beams (4, 5), with the beams possibly being displaceable or not. The disclosure will normally herewith address the case of one movable tool, in particular the top tool (2) being movable, but it is clear that the technical teaching can also be applied to the cases of alternatively the bottom tool (3) being movable and also both top and bottom tools (2, 3) being movable.

Usually, the workpiece only comprises a single piece, but more complex pieces may imply that the workpiece has different surfaces or even missing parts (e.g. holes) such that the tools may impact a discontinuous workpiece surface. Not so common, but also possible, is that the workpiece comprises more than one piece to be bent or pressed simultaneously.

A typical setup for a press brake (1) comprises support frames (6), usually lateral, that attach the bottom tool beam (45) and top tool beam (45) through some means of applying force. Some setups have only one support frame but in this case it is usually placed centrally, not laterally.

These force means (7) can be of various types such as electrical, pneumatic, or hydraulic. Hydraulic is fairly common for the kind of applications herewith discussed and will be used as an example in various embodiments of the present disclosure. These force means (7) of applying force are used for opposing the top tool (2) and the bottom tool (3) together, at two sides of the workpiece, in order to bend or press the workpiece.

Thus, some kind of displacement means are provided that ensure that the movable tools (or tools) move in a substantially predictable and controllable path and fashion into the workpiece, such that the bending or pressing of the workpiece is carried out consistently and uniformly.

Also, typically, the mentioned support frames are "C", or "jaw", shaped. In this way, the bottom and top tools (2) are opposed together through one or more frames that usually extend in the opposite direction from the front side of the press brake (the front side is the side that is usually reserved for operating and handling the workpiece). This direction, from front to back of the machine, is usually designated as transversal direction of the press brake (1). The "C" or "jaw" shape connects, by its extremes, the lower and top tool mounts, through said force means (7). The connection to the tools is usually, but not necessarily, through said tool mount beams (4, 5).

This enables applying said force means (7) connection between top and bottom tools (2, 3), while allowing both front and lateral free accesses to the press brake. It is easy to recognize that easily accessing the tool area of the machine facilitates workpiece insertion and removal, control and inspection of work in progress, and even equipment maintenance. This direction, from side to side of the press brake (1), is usually designated as longitudinal direction of the press brake (1).

Nevertheless, this has the disadvantage of creating an asymmetric effort as said force means (7) are applied. The effort imparted to the tools creates an effort in the direction of "opening" said "C", which has the consequence that the travel line of the movable tool will shift transversally, creating imperfections and varying angles of attack on the workpiece depending on the force that is applied. This creates difficulties in obtaining consistent controllable results in terms of bending or pressing of the workpiece, and can even cause damage to the workpiece and/or tools if the misalignment is substantial.

The disclosure comprises providing a second frame, or second set of frames, that do not provide significant support of the force means (7), but provide substantial guiding effort to the movable tool (or tools). This way, the first frame, or first set of frames, bears the main load of the force means (7) for bending or pressing, while the second frame, or second set of frames bears the alignment loads that ensure the workpiece is bent or pressed in a consistent uniform way. The first frame(s) is designated as the load bearing frame (61), while the second frame(s) is designated as the alignment frame (62).

The alignment frame (62) comprises sliding means (8) which slidingly couple the frame (62) to the movable tool (or tools) that ensure that the tool(s) move in a substantially predictable predefined path, even if the load bearing frame (61) is distorted by the effort being put into the workpiece. Preferably, said predefined path is linear. Further preferably, said sliding means (8) provide a sliding joint (8A and 8B) and, in this way, the predefined path is linear and also the angle of the tool is fixed (kept at constant angle with an angle collinear with the predefined path).

Said sliding means (8) can operate as a track (8B) for a sliding skate or sled part (8A), or as a predefined path formed by an axial slot (8B) and a mating flange (8A). Also, said flange may comprise rollers or roller bearings so that the friction between flange and slot is reduced.

Said sliding means may, or may not, accommodate some longitudinal twisting, that is, some rotation of the tool in the plane parallel to the tool displacement (longitudinal and vertical plane). This usually results from bending or pressing a workpiece that is not symmetrical or is not placed symmetrically relative to the tools, such that a twisting effort develops.

In some embodiments, this effort may be handled by the sliding means which then do not accommodate longitudinal twisting.

Alternatively, in further preferred embodiments of the disclosure, counteracting such rotational effort is left to the force means (7) and load bearing frames (61), leaving the sliding means only to ensure the tool path does not deform transversally. This may be easily accomplished by providing a roller or rollers (10) in the lateral parts (longitudinal direction) of the sled part contained in the axial slot, or by providing roller(s) in the lateral parts (longitudinal direction) of the axial slot containing the sled part, or both, with some lateral spacing.

The sliding means (8) may be directly coupled between the frame (62) and the movable tool (2), but the sliding means (8) are preferably coupled directly between the frame (62) and the movable beam (4), on which beam the tool (2) is thereupon mounted.

Furthermore, preferably a at least a pair of load bearing frames (61) and a pair of alignment frames (62) are provided such that the tools (2, 3) can be driven, in force and alignment, from two points thus obtaining better tool alignment and more consistent results, especially if the frames are positioned substantially to the sides of the press brake (1).

Preferably, the support frames are "C" or "jaw" shaped, protruding towards the back of the press brake (1) in the transversal direction. Other shapes are possible, for example a lying-on-its-side "U" shape, or a square angled "C" as in a lying-on-its-side 'TV' shape.

The "C" shape has the advantage of avoiding corners or tight angles. On the outside curve of the "C" shape, any corner is superfluous as the effort is not concentrated on the outside rim of the shape. On the inside curve of the "C" shape, any discontinuity or tight angle points will create unnecessary stress as the effort that is concentrated on the inside rim will be even more intense on such points.

Furthermore, the load bearing frame (61) and the alignment frame (62) can be provided jointly, especially if these are "C" shaped, making the set of the frames lighter while still maintaining robustness and alignment qualities.

In an embodiment, the frames are provided as two "C" shapes-the inner "C", the alignment frame (62), is enclaved in the outer "C", the load bearing frame (61). That is, the outer "C" shaped frame receives the inner "C" shaped frame in its "C" shape concave part.

In another embodiment, the alignment frame (62) is 'sandwiched' with the load bearing frame (61). That is, the alignment frame (62) and the load bearing frame (61) are overlapping and joined (attached, united) in a layered fashion, not in an enclaved fashion. In this case, the alignment frame (62), the load bearing frame (61), or both, comprise a C-shaped frame.

In a preferred embodiment, the load bearing frame (61) and the alignment frame (62) are joined, partially or fully, by the inner rim of the "C" shape.

In a preferred embodiment, the load bearing frame (61) and the alignment frame (62) are joined, partially or fully, by the outer rim of the "C" shape.

In a preferred embodiment, the load bearing frame (61) and the alignment frame (62) are joined partially by the inner rim of the "C" shape(s) and are joined partially by the outer rim of the "C" shape(s), in particular the outer rim of the "C"-shaped alignment frame (62).

In a preferred embodiment, the alignment frame (62) comprises two "C" shaped layers which are layered, "sandwiched", each on one side of a layer of the load bearing frame (61), and thus joined in a layered fashion. In another preferred embodiment, the alignment frame (62) comprises one "C" shaped layer which is layered, "sandwiched", between two layers of the load bearing frame (61), and thus joined in a layered fashion.

Preferably, the alignment frame (62) and the load bearing frame (61) are not fully joined. This allows the load bearing frame (61) to deform backwards (transversally) with the bending/pressing effort, while the alignment frame (62) is unhampered by the deformation because the frames are not fully joined. Furthermore, because they are partially joined, the alignment frame (62) can discharge efforts to/from the load bearing frame (61), reducing tension and deformation of the frames, thus obtaining a reinforcement effect of the frames while improving the alignment of the press brake (1) tools and improving the consistency of the produced workpieces.

The alignment frame (62) and the load bearing frame (61) are, for example, "C" shapes joined at the middle point. Preferably, the "C" shapes are only joined at one of the extremities of the "C" shape, which allows a simpler construction.

Preferably, the "C" shapes are joined at one of the extremities of the "C" shape and at the bottom side of the press brake (1), which also allows for an even simpler construction. This way the efforts are communicated between the frames at a zone that is less likely to affect the transversal alignment of the vertical movements of the top tool (or upper beam).

Preferably, the "C" shapes are joined from the bottom up to only a predetermined level. If the shapes are joined too far up, the load bearing effort of the outer shape is too strongly transmitted to the inner "C" shape unnecessarily distorting the inner alignment frame. If the shapes are joined not enough far up, a part of the efforts of the inner shape cannot be offloaded to the outer shape, such that said reinforcement effect of the inner alignment frame is not obtained.

In an embodiment, and as is generally used in the art, the top tool (2) is movable and the bottom tool (3) is fixed. Preferably, the tools are mounted on beams (4, 5), the top tool beam (4) being movable and the bottom tool beam (5) being fixed. in this case, the sliding means are preferably mounted on only the upper part of the alignment frame.

Preferably, the alignment frame (62) is "C" shaped, the load bearing frame (61) is at least "C" shaped in its inner rim; the load bearing frame (61) and the alignment frame (62) are partially joined (9A) by the inner rims of the "C" shapes of both frames (61, 62), the load bearing frame (61) and the alignment frame (62) are partially joined (9B) by the outer rim of the "C"-shaped alignment frame (62). In a preferred embodiment, the alignment frame (62) comprises two "C" shaped layers which are layered, "sandwiched", each on one side of a layer of the load bearing frame (61), and thus joined in a layered fashion.

Preferably, the "C" shape rims are joined from the bottom up to only a predetermined level. Each of the rims of the "C"-shaped alignment frame (62) can be joined up to a certain angle (α), see FIG. 8. If a is −45°, the frames are fully disjoined (other than being joined by the bottom beam), corresponding to embodiments previously described where the load bearing frame (61) and alignment frame (62) work independently. If α is 180°, the frames are fully joined, corresponding to prior art embodiments as the load-independent alignment effect is lost.

If the angle of the joint of the inner rims of the "C" shapes of both frames (61, 62) is −45° then the displacement of the tools is completely free from the load bearing effect and the alignment is best (+++) but there is no load discharge by the frames and there are tension concentration points (−). If the angle of the joint of the inner rims is increased, the alignment gradually worsens (++, +, −) reaching poor alignment (−−) conditions at 135°. As the load bearing frame (61) distorts under force, the total join of the frames by the inner rim does not necessarily minimize tensions. It was found that the best load support effect was obtained at around 0°.

If the angle of the joint of the outer rim of the "C"-shaped alignment frame (62) to the load bearing frame (61) is −45° then the displacement of the tools should be completely free from the load bearing effect, but in fact the alignment was not found to be best in this case (+). As the load bearing frame (61) distorts under force, the effort of the force means (7) is not collinear with the sliding means (8) of the alignment frame (62). As such, there is an advantage to having the frames partially connected such that the angle of the joint of the outer rim with best alignment results is around 45-90° (++). The load discharge by the frames is maximized at around 135°.

The preferred embodiments reflect a compromise between the effect of obtaining a load-independent alignment and the effect of tension discharging between frames such that the best possible consistency is obtained in terms of workpiece production, while maintaining press brake resilience.

In an embodiment, the outer rim joint angle is 98 to 102° and the inner rim joint angle is −2 to 2°.

In an embodiment, the outer rim joint angle is 90 to 105° and the inner rim joint angle is −5 to 5°.

In an embodiment, the outer rim joint angle is 85 to 110° and the inner rim joint angle is −10 to 10°.

In an embodiment, the outer rim joint angle is 75 to 120° and the inner rim joint angle is −20 to 20°.

TABLE 1

| α | Tension in the frames | | Alignment of the press brake tools | |
|---|---|---|---|---|
| (degrees) | Outer rim | Inner rim | Outer rim** | Inner rim |
| −45 | −−− | − | + | +++ |
| 0 | −− | + | + | +++ |
| 45 | − | −− | ++ | ++ |
| 90 | + | −− | ++ | + |
| 105 | ++ | −− | + | − |
| 135 | +++ | −− | − | −− |

Preferably, the joints are obtained by welding but other means are also possible like bolting, soldering, pin and socket, screws.

It is also preferable that the two "C" shaped joined frames are obtained from two different parts that are subsequently joined. This allows using different materials and/or material thicknesses, such that, for example, the load bearing frame (61) can be made of cheaper and/or lighter materials because its deformation is, according to the disclosure, less material to the alignment of the press brake (1) tools Preferably, the force means (7) drive the tool (or beam) through a joint or support that enables a degree of rotation, as the force means (7) will not be in full alignment with the displacement path of the movable tool (or beam) when the load bearing frame distorts under effort. This may be provided for example by a simple ball-joint or a round cap support. This is advantageous for force means (7) that are susceptible to lateral efforts, for example some kinds of hydraulic cylinders.

The above described embodiments are combinable. The dependent claims further set out particular embodiments of the invention.

BRIEF DESCRIPTION OF DRAWINGS

The following figures provide preferred embodiments for illustrating the description and should not be seen as limiting the scope of invention.

(1) represents press-brake machine (1),
(2) represents the top tool,
(3) represents the bottom tool,
(4) represents the upper beam which is displaceable,
(5) represents the table or fixed lower beam,
(6) represents support frames,
(61) represents a load bearing frame, a support frame mostly for supporting vertical forces,
(62) represents an alignment frame, a support frame mostly for supporting transversal forces, and
(7) represents force means, e.g. hydraulic cylinders.

Figure 1:
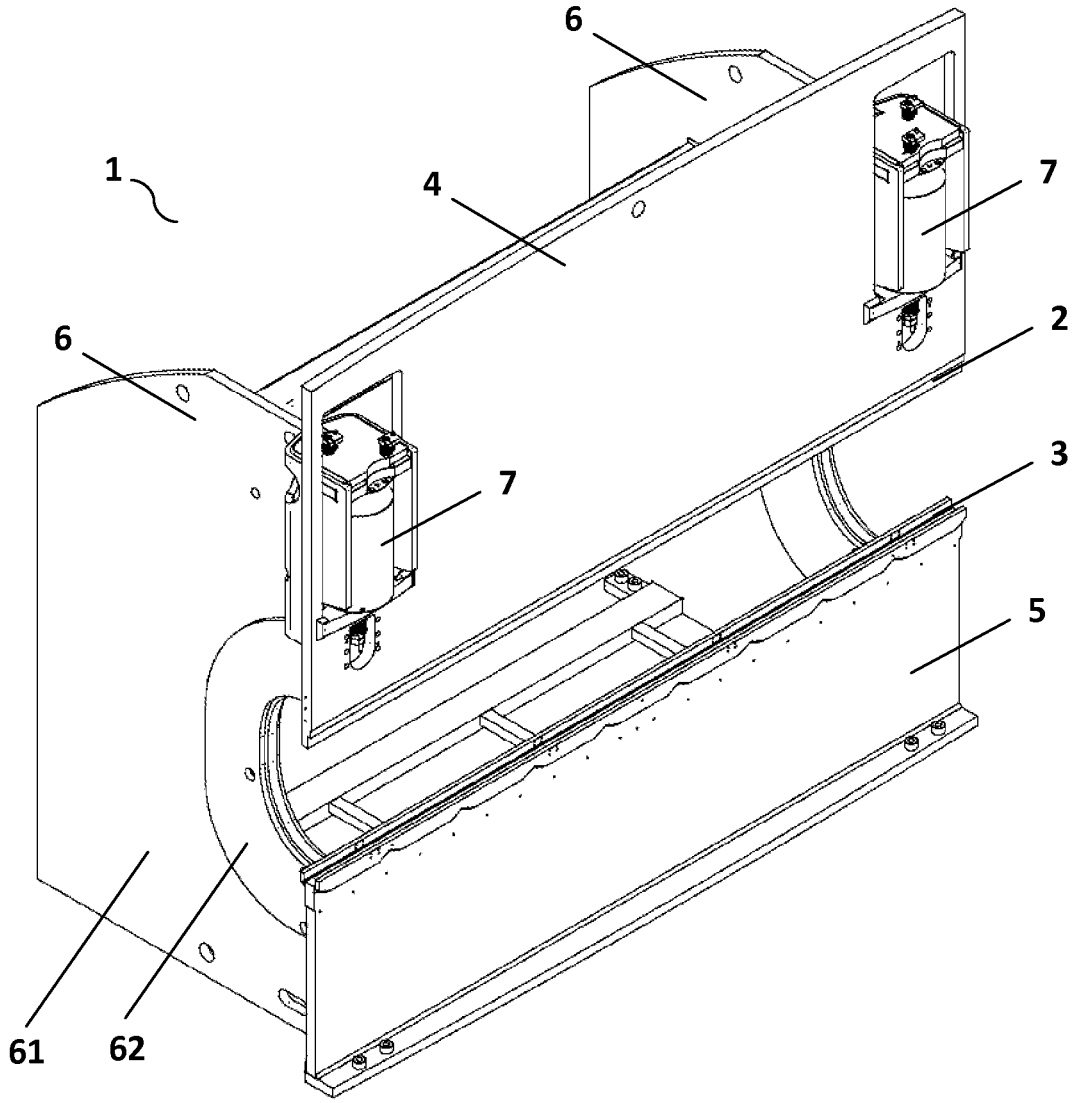
FIG. 1: Schematic representation of the front view of a press brake embodiment where.
Figure 2:
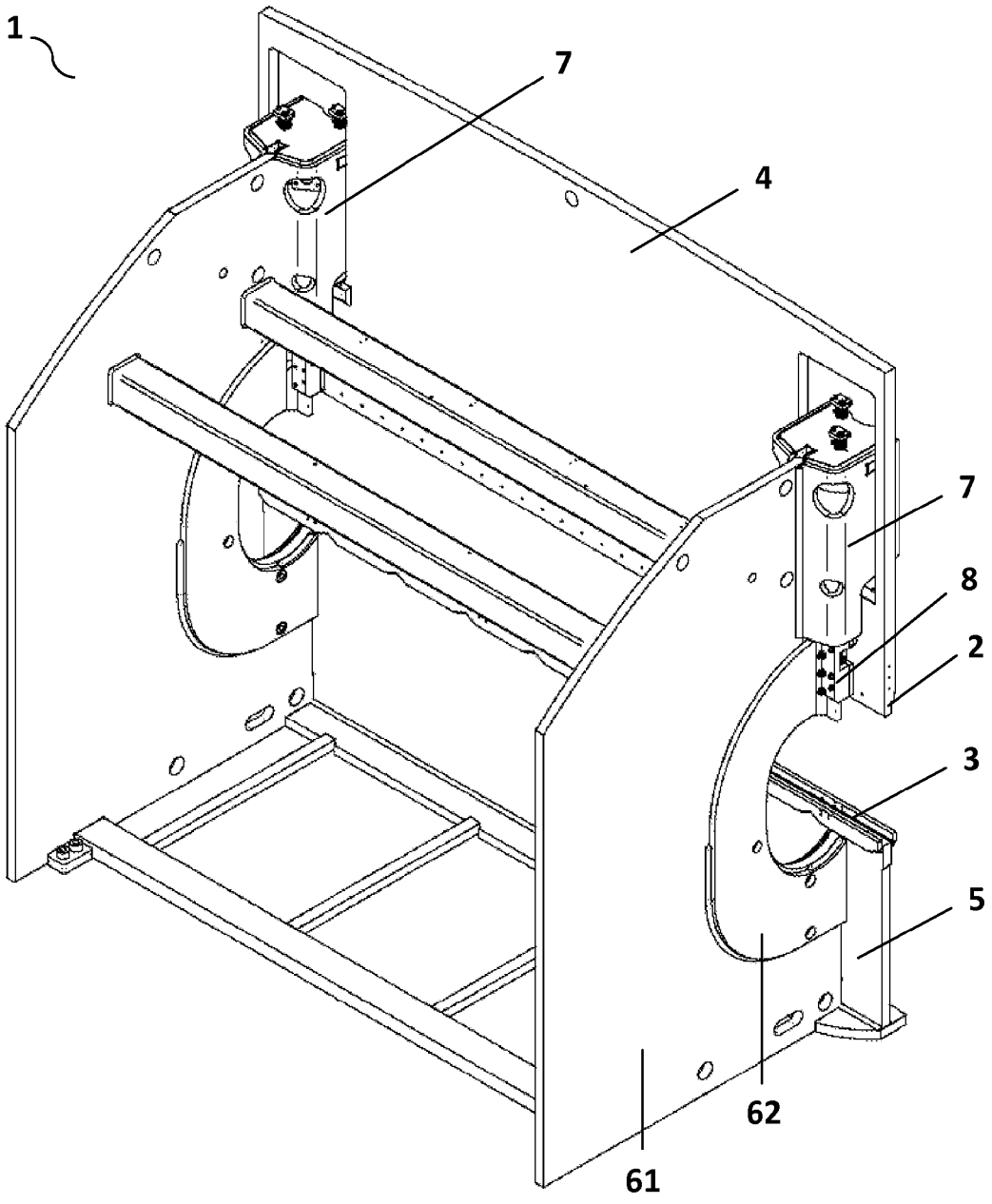

FIG. 2: Schematic representation of the back view of a press brake embodiment where (8) represents sliding means between the alignment frame and the upper beam.

Figure 3:
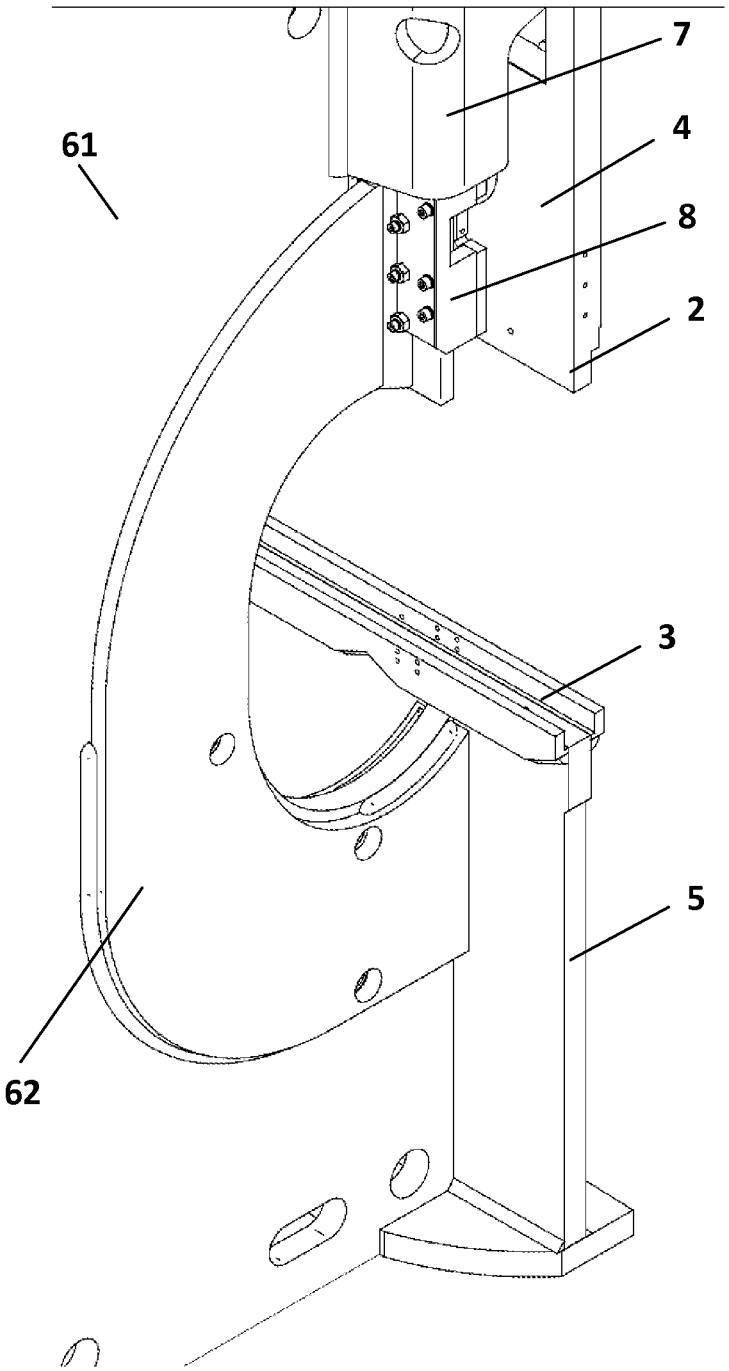

FIG. 3: Schematic representation of the lateral view of a press brake embodiment.

Figure 4:
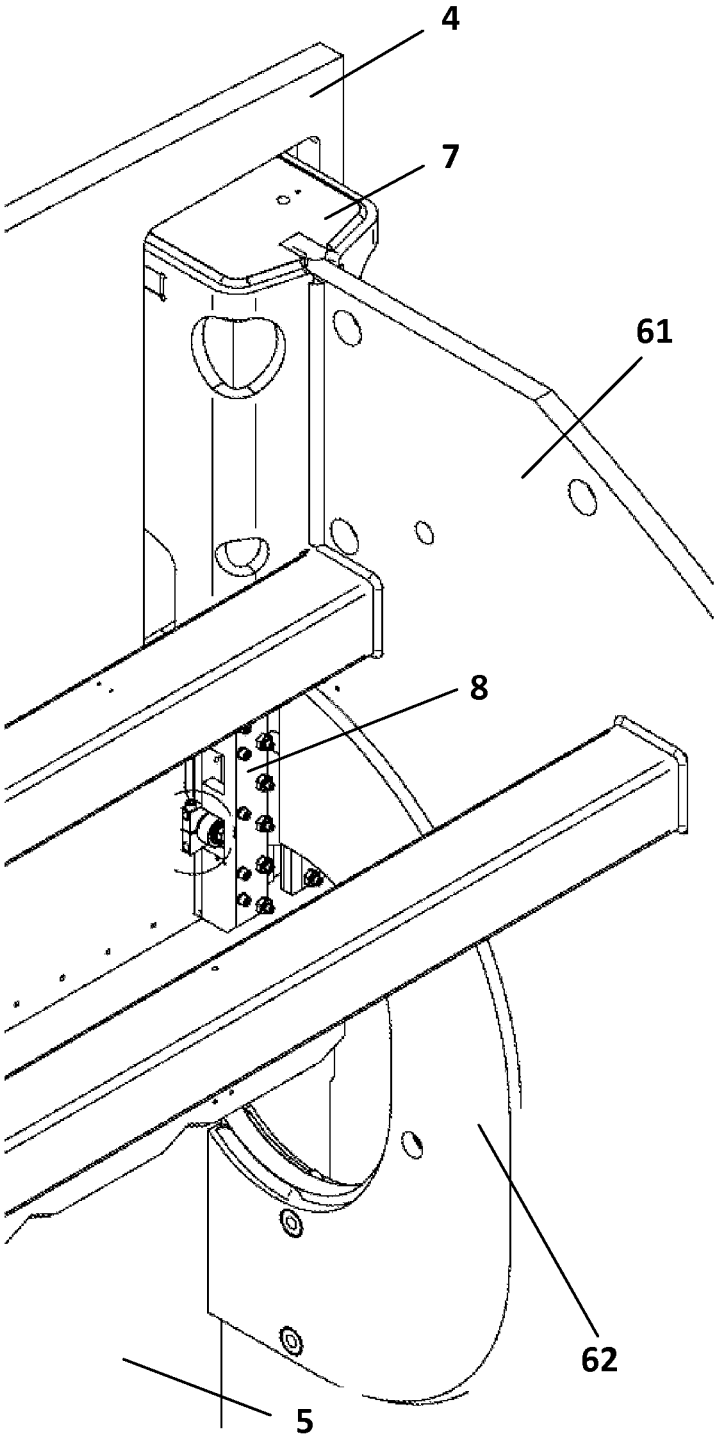

FIG. 4: Schematic representation of the inside view of a press brake embodiment.

Figure 5:
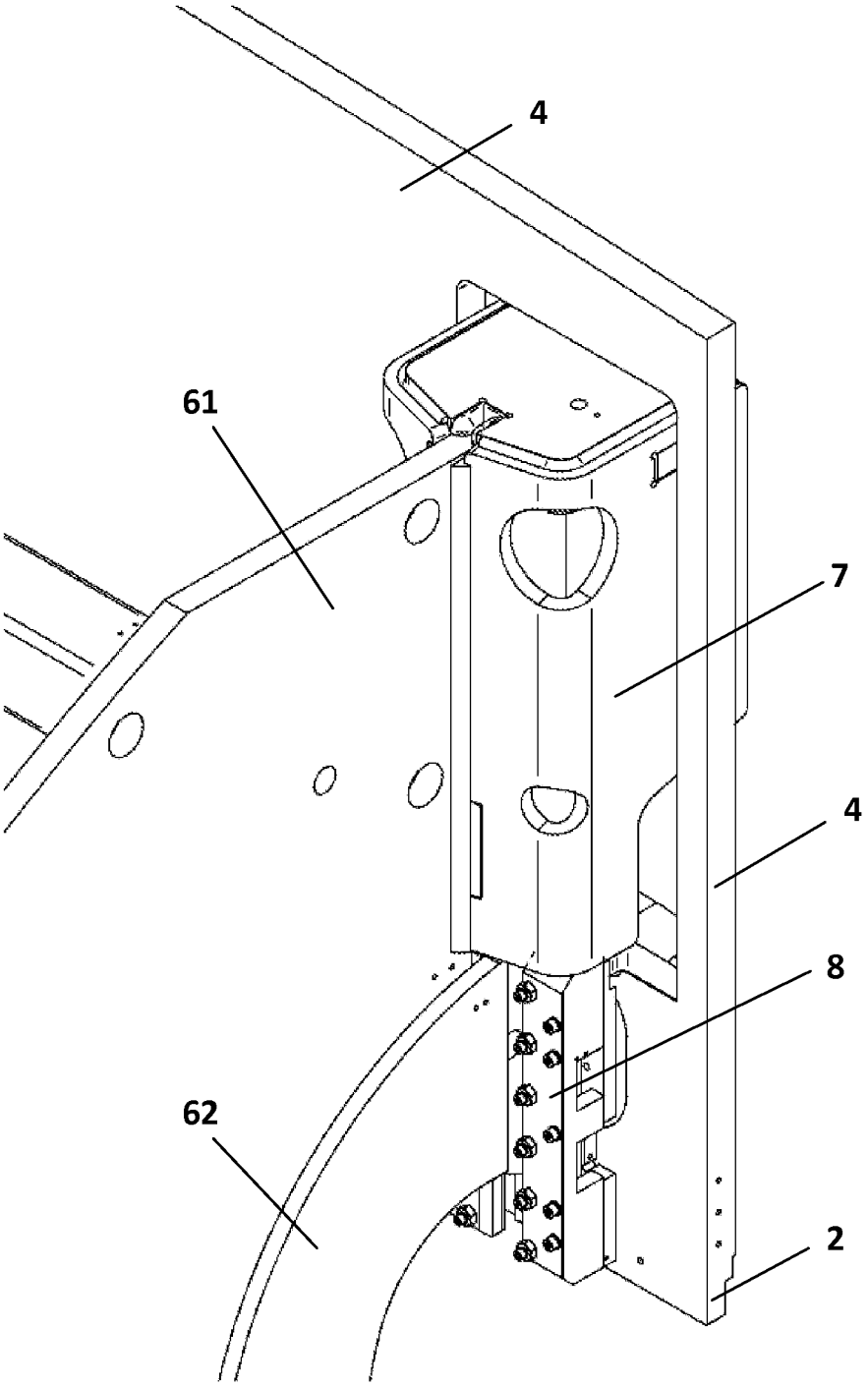

FIG. 5: Schematic representation of a press brake embodiment with the sliding means (8) slidingly coupling the alignment frame (62) to the top tool beam (4); the force means (7) are placed between the load bearing frame (61) and the top tool beam (4).

Figure 6:
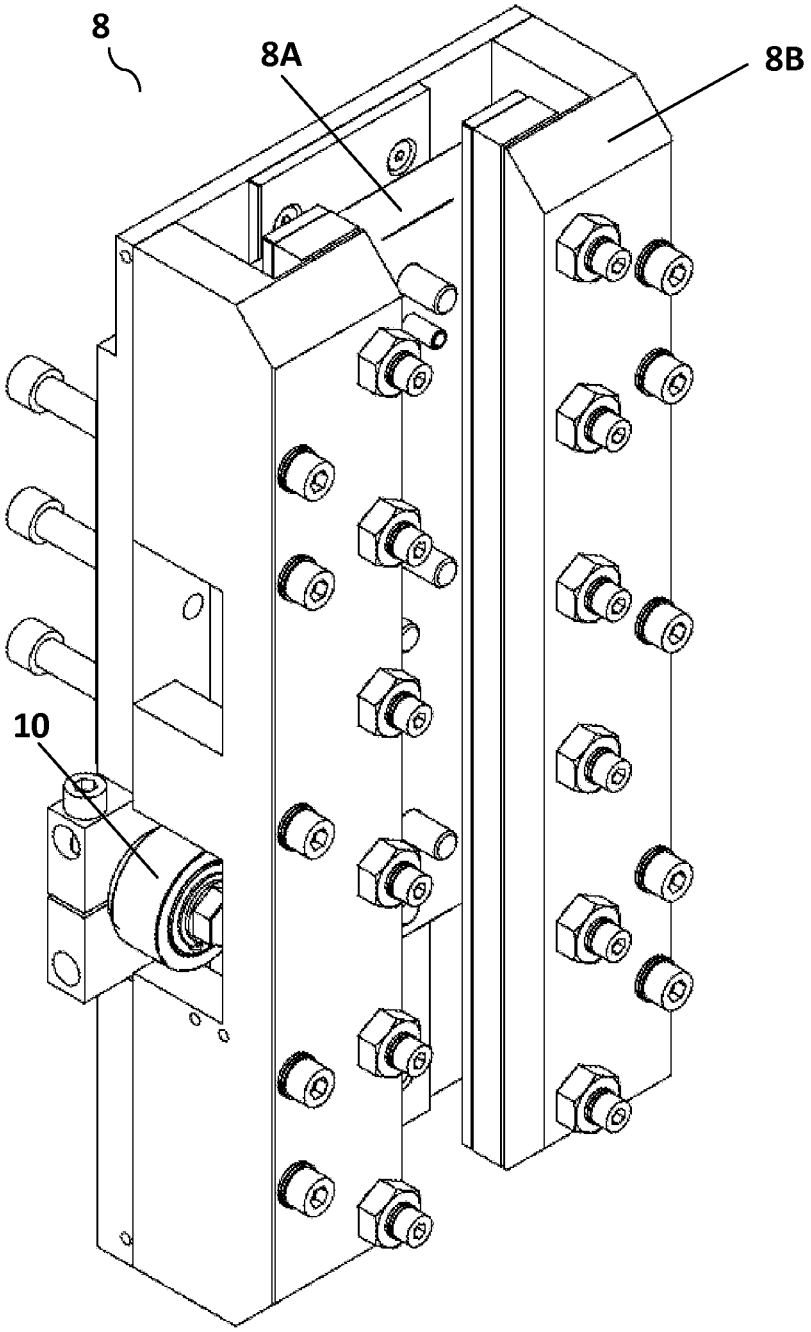

FIG. 6: Schematic representation of the sliding means (8) where:

(8A) represents a skate part of the sliding means,
(8B) represents a track part of the sliding means, and
(10) represents a lateral roller for the sliding means enabling a certain degree of rotation of the top tool beam in a longitudinal and vertical plane.

Figure 7:
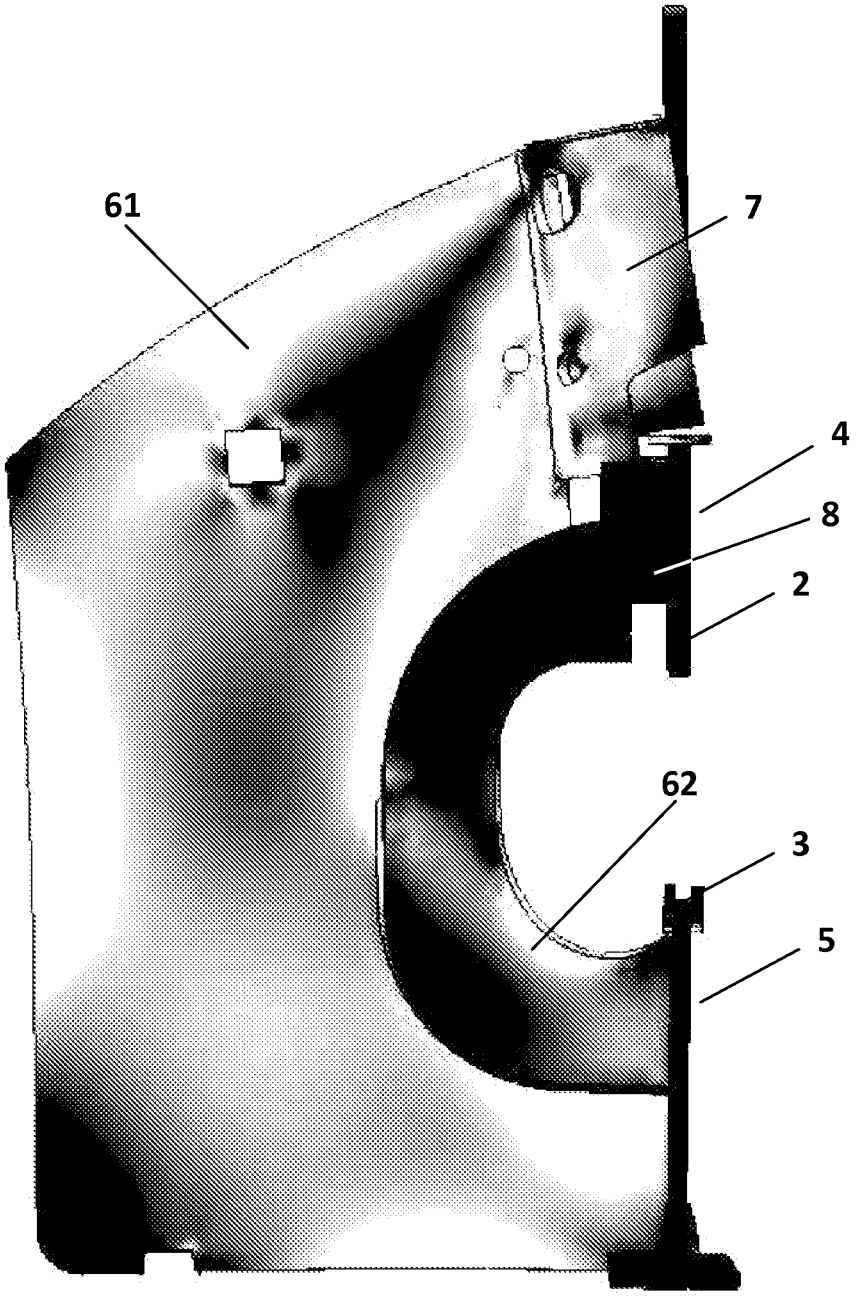

FIG. 7: Simulation of a press brake embodiment showing in lighter colours the areas of tension concentration, showing how the tension is mostly avoided in the alignment frame (62).

Figure 8:
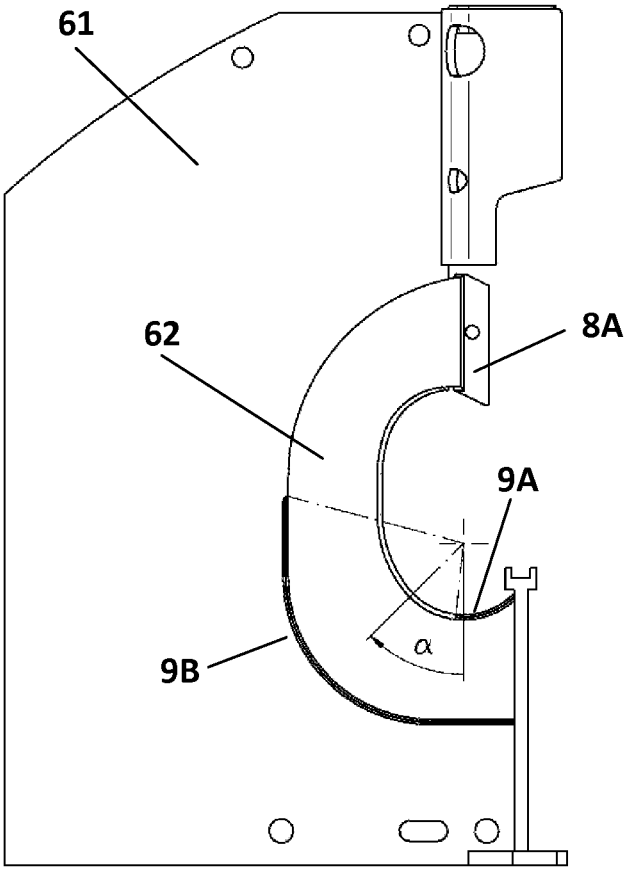

FIG. 8: Schematic representation of a press brake embodiment where $\alpha$ represents the angle up to which the load bearing frame (61) and the alignment frame (62) are joined at the "C"-shaped rims, where:

(9A) represents the join between the "C"-shaped inner rims of the load bearing frame and the alignment frame, and
(9B) represents the join between the "C"-shaped outer rim of the alignment frame and the load bearing frame.

Figure 9:
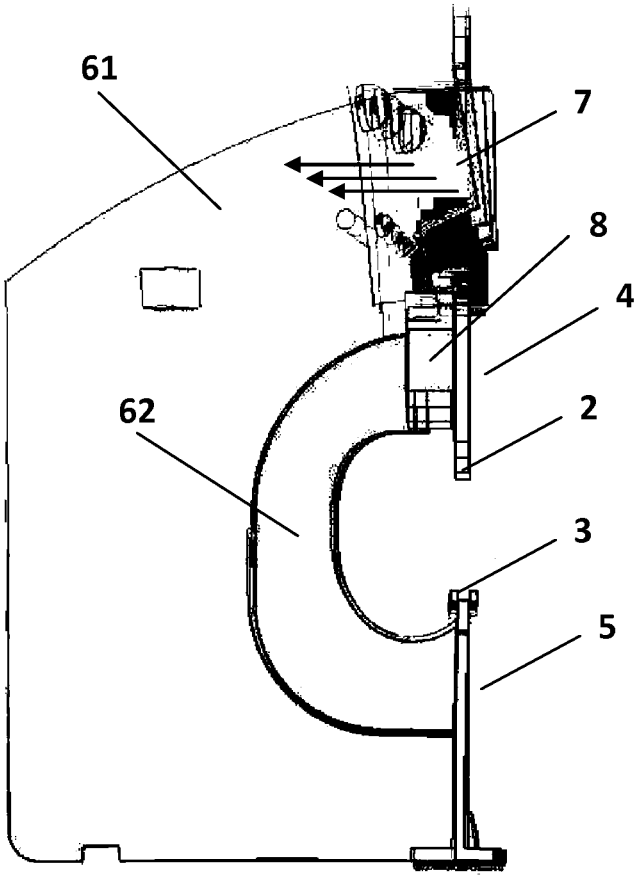

FIG. 9: Schematic representation of a press brake embodiment showing the backwards displacement of the load bearing frame (61) under pressing effort, while the alignment frame (62) is mostly unaffected.

The invention claimed is:

1. A press brake for bending or pressing workpieces, comprising a top tool and a bottom tool, for bending or pressing workpieces between said opposing tools;
a displaceable upper beam, wherein the top tool is mounted thereon;
a bottom beam, wherein the bottom tool is mounted thereon, said bottom beam being substantially parallel to the displaceable upper beam;
a load bearing frame mounted extending transversally to said beams, comprising a concave opening facing said beams, wherein the bottom beam is mounted on a lower part of the load bearing frame relative to the concave opening;
force means mounted between the upper beam and an upper part of the load bearing frame relative to the concave opening, for moving the top tool towards the bottom tool;
wherein:
an alignment frame is mounted extending transversally to said beams, comprising a concave opening facing said beams, wherein the bottom beam is mounted on a lower part of the alignment frame relative to the concave opening;
sliding means is mounted between the upper beam and an upper part of the alignment frame relative to the concave opening, wherein the alignment frame and the load bearing frame are joined by joining part of overlapping inner rims of the concave openings of each frame; and
the joined part of the overlapping inner rims of the concave openings extends from the joining of the load bearing and alignment frames to the bottom beam up to a predetermined inner rim joint angle ($\alpha$), said angle being measured from the bottom beam direction along the concave opening towards the upper beam direction.

2. The press brake according to claim 1 wherein the sliding means is a sliding joint.

3. The press brake according to claim 2 wherein the sliding means comprise an axial slot and a mating flange.

4. The press brake according to claim 1 wherein the sliding means are adapted to accommodate a predefined degree of rotation of the upper beam in a plane parallel to the upper beam displacement.

5. The press brake according to claim 1 wherein the load bearing frame and the alignment frame are partially joined.

6. The press brake according to claim 1 wherein the alignment frame and the load bearing frame comprise layers which overlap and are partially joined.

7. The press brake according to claim 1 wherein the predetermined inner rim joint angle ($\alpha$) is −20 to 20°.

8. The press brake according to claim 1 wherein the alignment frame is "C"-shaped.

9. The press brake according to claim 8 wherein the alignment frame and the load bearing frame are joined by joining part of an outer rim of the alignment frame to the load bearing frame.

10. The press brake according to claim 9 wherein the joined part of the outer rim of the alignment frame extends from the joining of the load bearing and alignment frames to the bottom beam up to a predetermined outer rim joint angle ($\alpha$), said angle being measured from the bottom beam direction along the concave opening towards the upper beam direction.

11. The press brake according to claim 10 wherein the predetermined outer rim joint angle (α) is 75 to 120°.

12. The press brake according to claim 1 wherein the load bearing frame is "C"-shaped.

13. The press brake according to claim 1 comprising two alignment frames joined in layers, each on a side of a load bearing frame layer.

14. The press brake according to claim 1 wherein the sliding means are adapted to impart a predefined path to the movement of the upper beam.

15. The press brake according to claim 14 wherein the sliding means are further adapted to impart a predefined direction to the upper beam movement along said predefined path.

16. The press brake according to claim 7, wherein the predetermined outer rim joint angle (α) is −10 to 10°.

17. The press brake according to claim 7, wherein the predetermined outer rim joint angle (α) is −5 to 5°.

18. The press brake according to claim 7, wherein the predetermined outer rim joint angle (α) is −2 to 2°.

19. The press brake according to claim 11, wherein the predetermined outer rim joint angle (α) is 85 to 110°.

20. The press brake according to claim 11, wherein the predetermined outer rim joint angle (α) is 90 to 105°.

21. The press brake according to claim 11, wherein the predetermined outer rim joint angle (α) is 98 to 102°.

22. A press brake for bending or pressing workpieces, comprising a top tool and a bottom tool, for bending or pressing workpieces between said opposing tools;

a displaceable bottom beam, wherein the bottom tool is mounted thereon;

a stationary upper beam, wherein the top tool is mounted thereon, said upper beam being substantially parallel to the bottom beam;

a load bearing frame mounted extending transversally to said beams, comprising a concave opening facing said beams, wherein the upper beam is mounted on an upper part of the load bearing frame relative to the concave opening;

force means mounted between the lower beam and the bottom part of the load bearing frame relative to the concave opening, for moving the bottom tool towards the top tool;

wherein:

an alignment frame is mounted extending transversally to said beams, comprising a concave opening facing said beams, wherein the upper beam is mounted on an upper part of the alignment frame relative to the concave opening;

sliding means is mounted between the bottom beam and a lower part of the alignment frame relative to the concave opening, wherein the alignment frame and the load bearing frame are joined by joining part of overlapping inner rims of the concave openings of each frame; and the joined part of the overlapping inner rims of the concave openings extends from the joining of the load bearing and alignment frames to the upper beam up to a predetermined inner rim joint angle (α), said angle being measured from the upper beam direction along the concave opening towards the bottom beam direction.

* * * * *